US011434449B2

(12) United States Patent
Faist

(10) Patent No.: US 11,434,449 B2
(45) Date of Patent: Sep. 6, 2022

(54) APPARATUS FOR HOLDING AND CENTERING A CANDLE WICK IN A CONTAINER

(71) Applicant: Herrhammer GmbH Spezialmaschinen, Ochsenfurt (DE)

(72) Inventor: Bernd Faist, Ochsenfurt (DE)

(73) Assignee: HERRHAMMER GMBH SPEZIALMASCHINEN, Ochsenfurt (DE)

( * ) Notice: Subject to any disclaimer, the term of this patent is extended or adjusted under 35 U.S.C. 154(b) by 141 days.

(21) Appl. No.: 16/676,790

(22) Filed: Nov. 7, 2019

(65) Prior Publication Data

US 2020/0157466 A1 May 21, 2020

(30) Foreign Application Priority Data

Nov. 19, 2018 (DE) ..... 20 2018 106 552.1

(51) Int. Cl.
*C11C 5/00* (2006.01)
*C11C 5/02* (2006.01)

(52) U.S. Cl.
CPC ..... *C11C 5/006* (2013.01); *C11C 5/023* (2013.01)

(58) Field of Classification Search
CPC ..... C11C 5/006; C11C 5/02; C11C 5/023
See application file for complete search history.

(56) References Cited

U.S. PATENT DOCUMENTS

| | | | | |
|---|---|---|---|---|
| 1,810,019 | A * | 6/1931 | Jaworsky | B60K 15/0406 220/825 |
| 2,800,244 | A * | 7/1957 | Witt | B65F 1/1607 220/254.5 |
| 3,045,855 | A * | 7/1962 | Lipman | F21V 35/00 215/377 |
| 3,721,419 | A * | 3/1973 | Bolinger | C11C 5/023 249/93 |
| 6,318,557 | B1 | 11/2001 | Zehnder | |
| 10,844,320 | B2 * | 11/2020 | Alexander | C11C 5/023 |
| 2003/0134242 | A1 * | 7/2003 | Hart | F23Q 25/00 431/33 |
| 2005/0239010 | A1 * | 10/2005 | Duska | F23D 3/30 431/288 |
| 2006/0081585 | A1 * | 4/2006 | Pierce | B26B 29/02 219/229 |

(Continued)

FOREIGN PATENT DOCUMENTS

| | | | | |
|---|---|---|---|---|
| DE | 10 2010 000 283 | A1 | 7/2011 | |
| EP | 1520907 | A1 * | 4/2005 | F23D 3/16 |
| GB | 190212734 | A * | 8/1902 | |

OTHER PUBLICATIONS

Candlewic; Candlewic~Wick Centering Devices; Jun. 27, 2014; https://www.youtube.com/watch?v=ou5TGL1g3TE (Year: 2014).*

(Continued)

*Primary Examiner* — Jorge A Pereiro
*Assistant Examiner* — Logan P Jones
(74) *Attorney, Agent, or Firm* — Maier & Maier, PLLC

(57) ABSTRACT

An apparatus is provided for holding and centering a candle wick in a container. The apparatus according to the invention is characterized in that a fixing apparatus is provided for the candle wick, which can be connected to the container in a detachable in such a way that it can be pivoted relative to the container.

18 Claims, 3 Drawing Sheets

(56) References Cited

U.S. PATENT DOCUMENTS

| | | | | |
|---|---|---|---|---|
| 2012/0137634 | A1* | 6/2012 | Cagle | C11C 5/021 53/431 |
| 2016/0038623 | A1* | 2/2016 | Hopkins | A61L 9/03 422/124 |
| 2016/0201899 | A1* | 7/2016 | Kleffmann | F23D 3/16 431/291 |
| 2020/0071636 | A1* | 3/2020 | Alexander | C11C 5/006 |

OTHER PUBLICATIONS

Nature's Garden; Best Ways to Center Candle Wicks; Sep. 18, 2014; https://www.naturesgardencandles.com/blog/tag/how-to-center-candle-wicks/ (Year: 2014).*

* cited by examiner

APPARATUS FOR HOLDING AND CENTERING A CANDLE WICK IN A CONTAINER

FIELD

The present disclosure relates to an apparatus for the automatic holding and positioning of a candle wick in a container after the mechanical wicking of the container and during the solidification of the filled burning mass.

BACKGROUND

In general, different methods for producing candles are known from prior art. In particular, candles can be produced using filling methods or casting methods for example. In the case of "filled" or "cast" candles produced in connection with filling methods or casting methods, burning mass, for example wax, is initially filled into a container, which can be made, in particular, of glass, plastic, cardboard, metal, etc. The burning mass filled in this way is at least temporarily in a liquid as well as, in particular, in a pasty state. A candle wick or a candle wick element, which has either already been positioned in the container before the filling process or is positioned following the filling process, must be fixed, re-centered and straightened during the solidification period in order to meet optical aesthetic and, above all, safety requirements. Subsequent further processes are carried out, such as overcoating and surface heating for example, in particular, for post-treating the traces of centering and straightening the candle wick or candle wick element, according to the specific requirements at hand.

Manual or also automated methods or processes are used for candle wick centering and candle wick straightening in accordance with prior art.

A well-known method is, for example, to hold or clamp the candle wick, in particular, the upper end of the candle wick, by means of a clamp similar to a clothespin, or by means of a fastener for example. For this purpose, the clamp or fastener is preferably supported at the edge of the container. The insertion of the wick into the clamp is done manually.

In addition, for example, a method is known in which the candle wick is also manually centered and straightened by means of a pair of pincers.

Furthermore, a product-specific method as well as a product-customised apparatus for centering and straightening the candle wick is also known from U.S. Pat. No. 6,318,557 B1. This apparatus has a device for picking up and positioning a variety of candle containers. In addition, this apparatus includes a device for holding a variety of candle wick elements, each intended for the variety of containers. When the containers are completely filled with burning mass, the device for holding the candle wick elements is placed on the containers, whereby the candle wick elements are centered and straightened accordingly for each container.

Usually, the time span of centering and straightening is determined by the solidification period of the burning mass, which, for each candlestick, usually depends on the shape of the container, the type of burning mass used and its composition, as well as the temperatures of the filled burning mass and the ambient temperature, via which energy is dissipated, and is therefore different. In automated systems, as a rule, the containers are located on the floor, on cooling belts, shelves or tables in order to ensure partial solidification of the burning mass.

However, the conventional manufacturing methods as well as apparatuses for the production of such candles have the disadvantage that the manufacturing processes are becoming increasingly complex due to the subsequent centering and straightening of the candle wick elements and the associated subsequent and upstream processes. This results in high production costs. Furthermore, the apparatuses for the production of such candles are usually extremely limited in their mobility, at least in connection with automated processes.

Furthermore, the state-of-the-art apparatuses for the manufacture of candles are usually individually matched to the respective candle to be produced. This inevitably leads to high costs, as different candlesticks also require different designed apparatuses for making these candles.

Another prior art according to DE 10 2010 000 283 describes a method and an apparatus in which the wick for the candle is automatically centered and held. However, this method has the disadvantage of an elaborate and expensive device, which is required for wicking, fixing and transporting the apparatus.

SUMMARY

The object of the invention is now to eliminate or to at least mitigate the disadvantages resulting from prior art.

According to the invention, an apparatus for holding and centering a candle wick is provided in a container, which is characterized in that a fixing apparatus for the candle wick is provided, which is can be connected to the container in a detachable manner in such a way that it can be pivoted relative to the container.

Preferably, the fixing apparatus can be connected to the container in such a way that it can be pivoted relative to the container and can be linearly moved.

Even more preferably, a centering apparatus is provided, which is can be set onto the container in a detachable manner and to which the fixing apparatus can be attached.

In accordance with a preferred embodiment of the invention, the centering apparatus can be set onto the edge of the container.

Preferably, the centering apparatus is a centering ring that centeres inside or outside at the edge of the container.

Being furthermore preferred, a spring element is provided, by means of which the fixing apparatus can be pivoted back into a horizontal resting position.

It is also advantageous if the spring element is a return spring.

In accordance with a further preferred embodiment of the invention, the fixing apparatus has at least one fixing fork, which has a free end, which has a V-shaped recess for the candle wick.

Preferably, the fixing apparatus has two diametrically opposite fixing forks with one jaw each, between which the candle wick can be clamped.

Even more preferably, the fixing apparatus has terminal strips, clamping brackets, clamping wires or clamping plates.

Being furthermore preferred, an adapter is provided, which is coupled to the centering apparatus.

Being particularly preferably, the centering apparatus can be inserted into the adapter in a positive-locking manner.

Preferably, a plurality of fixing apparatuses for a plurality of wicks are provided.

The invention has the advantage that the candle wick remains automatically taut and centered in the container during or after the automatic wicking of the container as well as during the subsequent filling.

Furthermore, the invention also has the advantage that filling or casting systems, which already exist and are already in use, can be retrofitted cost-effectively, regardless of the container size used.

BRIEF DESCRIPTION OF THE DRAWINGS

The disclosure is described using a preferred embodiment as an example. The figures show.

DETAILED DESCRIPTION

Figure 1:
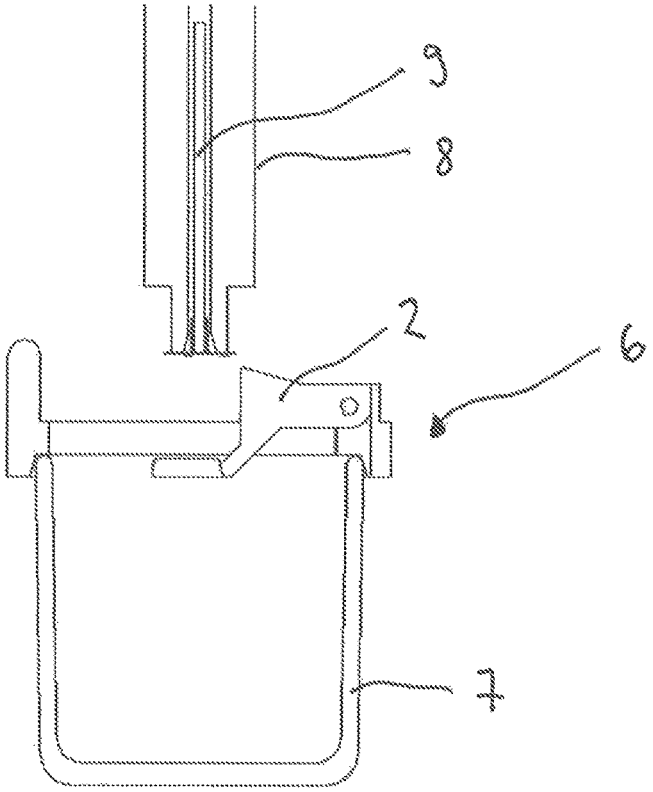
FIG. 1 a holding and positioning apparatus 6 which is placed onto a container 7 prior to automatic wicking.
Figure 2:
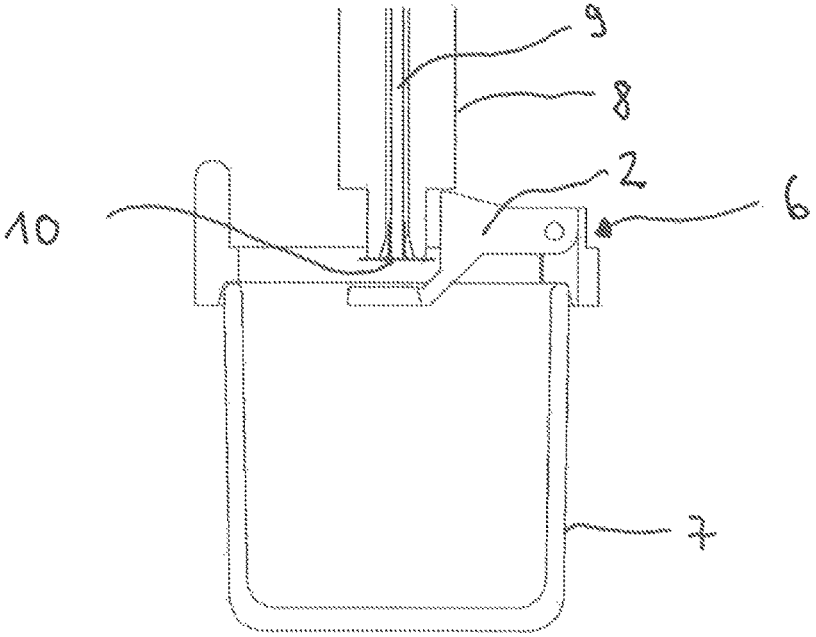
FIG. 2 a tappet 8 with a wick 9 and wick plate 10 at the point in time when the tappet plunges into the container 7, thereby actuating the fixing fork 2.
Figure 3:
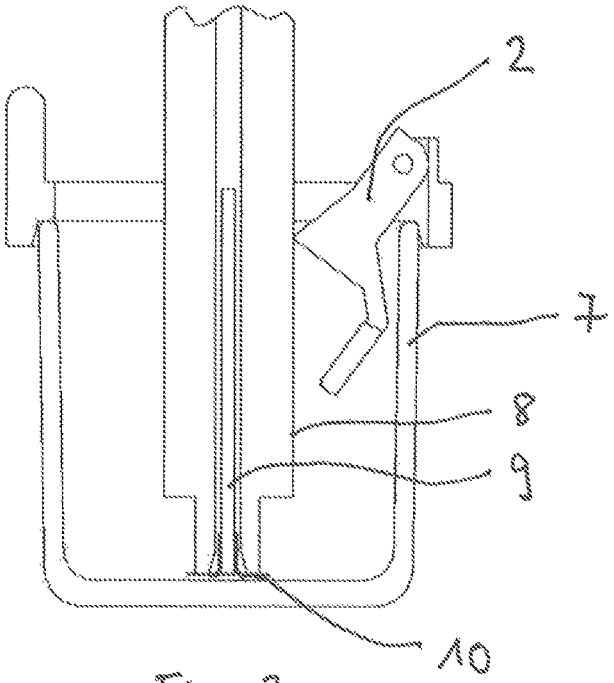
FIG. 3 the fully plunged tappet 8 and the fixing fork 2 being opened thereby.
Figure 4:
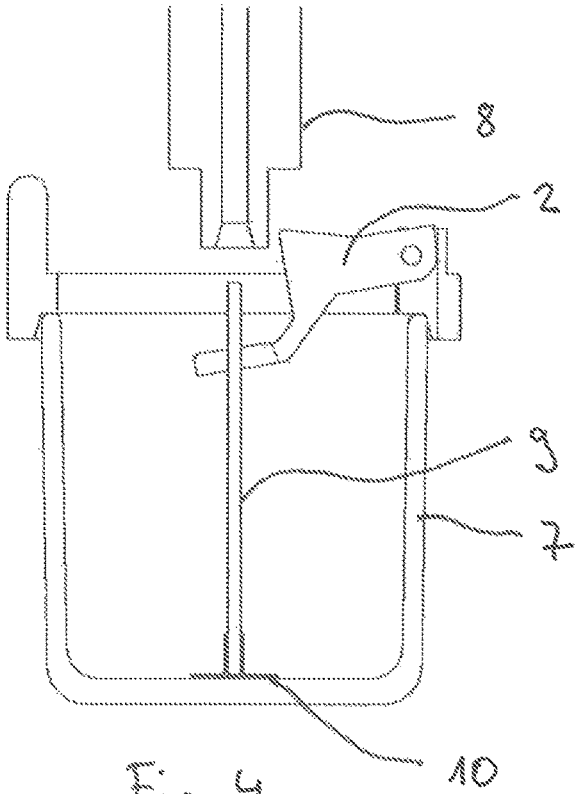
FIG. 4 the tappet 8 after it has been withdrawn from the container 7 and the fixing fork 2 tautens, centeres and clamps the wick due to the restoring force of the spring 3.
Figure 5:
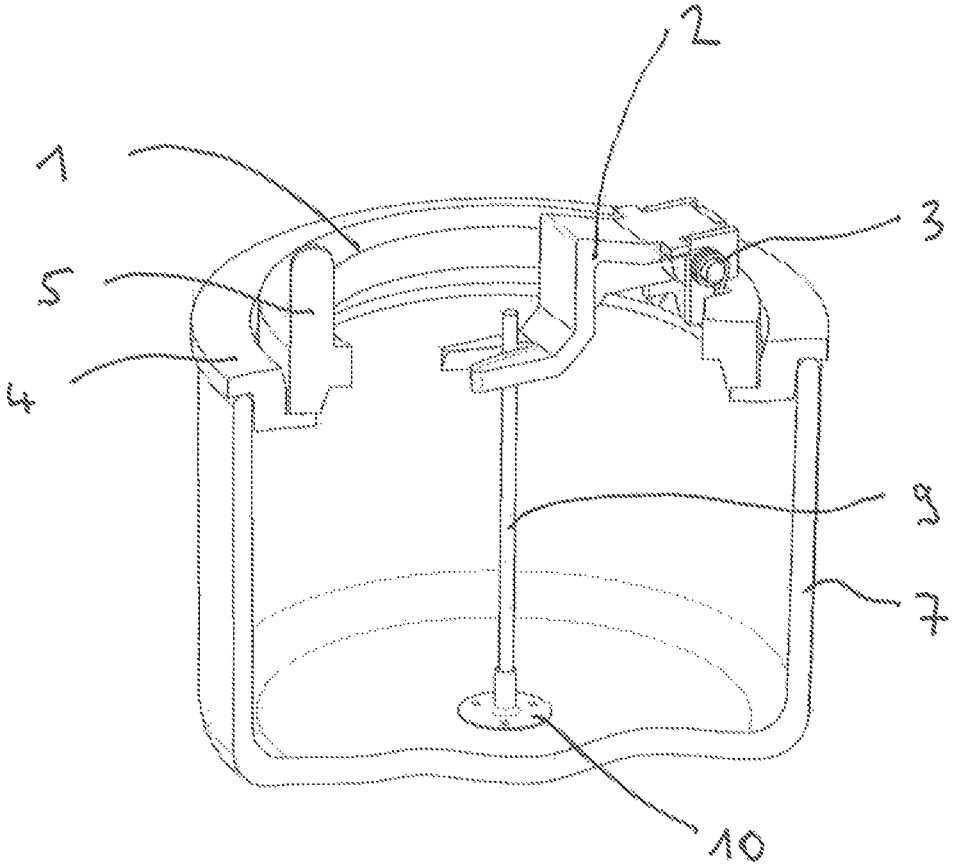
FIG. 5 a centering ring 1, the fixing fork 2, the return spring 3, the marking 5 as well as the fixed wick 9 after automatic wicking; here, with an adapter ring 4 for another container size.

The apparatus according to the invention is preferably already placed by hand or by means of an automatic auxiliary device onto the edge of the container to be filled when laying the containers 7 onto a system for producing cast or filled candles prior to wicking. However, this process can also take place at a later point in time after the containers 7 have been placed into the candle making machine.

During the subsequent passage of the containers 7 through an automatic (or also manual) wicking machine, the apparatus according to the invention is actuated by the tappet of the wicking machine, in which a pre-lengthened wick 9 provided with a wick plate 10 is located.

In this case, preferably a fixing fork 2 (in the case of two (or more) fixing forks 2, preferably both fixing forks 2), which is/are attached to a centering ring 1 in a rotatable or pivotable manner and preferably, in addition to this, in a linearly movable manner, is/are impressed by the tappet 8 of the wicking machine when plunging into the container 7 and is pivoted downwards into the direction of the inside of the container. Before pivoting, the fixing fork 2 can preferably be linearly moved downwards in the direction of the container edge. As soon as the tappet 8 is withdrawn from the container 7, wherein the wick 9 remains fixed to its wick plate 10 at the bottom of the container 7, the fixing fork(s) 2 pivot(s) back to its/their original preferably horizontal position by means of the spring 3. The upper free end of the wick 9 remains clamped and centered in the container by the free end of the fixing fork 2 (or by the shape of both fixing forks 2). In the case that the fixing fork 2 is automatically linearly moved upwards under a spring pre-load after pivoting, the wick 9 is additionally tautened.

The wicked container 7 with the wick-holding and positioning apparatus according to the invention now leaves the wicking machine and can then be fed to a filling machine by means of conveyor belts without requiring any further manual intervention for the fixation of the wick.

The holding and positioning apparatus can preferably be provided with a marking 5 so that the filling nozzle or the liquid or pasty material (burning mass) can enter into the container 7 between the/the fixing fork(s) 2 and the centering ring 1 during the later filling of the container 7.

The diameter of the centering ring 1 depends on the container diameter. The holding and positioning apparatus can be utilized by using a respective adapter ring 4 for different container diameters.

The holding and positioning apparatus according to the invention can be removed by hand or by means of an automatic auxiliary device after the solidification of the burning mass and then be fed to other containers 7 that are still to be filled.

A subsequent straightening of the wick is no longer necessary due to the apparatus according to the invention.

REFERENCE LIST

1 centering ring
2 fixing fork
3 spring
4 adapter ring
5 marking
6 complete holding and positioning apparatus
7 container
8 tappet
9 waxed wick
10 wick plate

The invention claimed is:

1. An apparatus for holding and centering a candle wick in a container, comprising:

a fixing apparatus for the candle wick, which is connectable to the container in a detachable manner, and when connected to the container, the fixing apparatus is pivotable about a horizontal axis into the interior of the container;

wherein the fixing apparatus has at least one fixing fork which has a free end for the candle wick; and wherein, when the fixing fork is in a resting position, the free end is disposed below the horizontal pivoting axis.

2. The apparatus according to claim 1, wherein the fixing apparatus is connectable to the container in such a way that it is pivotable and linearly moveable relative to the container.

3. The apparatus according to claim 1, wherein a centering apparatus is provided, which is mountable onto the container in a detachable manner, and to which the fixing apparatus is attachable.

4. The apparatus according to claim 3, wherein the centering apparatus is mountable onto to an edge of the container.

5. The apparatus according to claim 3, wherein the centering apparatus is a centering ring that centers inside or outside at the edge of the container.

6. The apparatus according to claim 1, wherein a spring element is provided, by which the fixing apparatus is pivotable back into the resting position, the resting position being horizontal.

7. The apparatus according to claim 6, wherein the spring element is a return spring.

8. The apparatus according to claim 1, wherein the free end of the fixing fork has a V-shaped recess for the candle wick.

9. The apparatus according to claim 3, wherein an adapter ring is provided, which can be coupled to the centering apparatus.

10. The apparatus according to claim 9, wherein the centering apparatus is insertable into the adapter ring in a positive-locking manner.

11. The apparatus according to claim 1, wherein a plurality of fixing apparatuses is provided for a plurality of candle wicks.

12. The apparatus according to claim 2, wherein a spring element is provided, by which the fixing apparatus is pivotable back into the resting position, the resting position being horizontal.

13. The apparatus according to claim 3, wherein a spring element is provided, by which the fixing apparatus is pivotable back into the resting position, the resting position being horizontal.

14. The apparatus according to claim 4, wherein a spring element is provided, by which the fixing apparatus is pivotable back into the resting position, the resting position being horizontal.

15. The apparatus according to claim 5, wherein a spring element is provided, by which the fixing apparatus is pivotable back into the resting position, the resting position being horizontal.

16. The apparatus according to claim 2, wherein the free end of the fixing fork has a V-shaped recess for the candle wick.

17. The apparatus according to claim 3, wherein the free end of the fixing fork has a V-shaped recess for the candle wick.

18. The apparatus according to claim 4, wherein the free end of the fixing fork has a V-shaped recess for the candle wick.

* * * * *